US008607479B2

(12) United States Patent
Schwarz

(10) Patent No.: US 8,607,479 B2
(45) Date of Patent: Dec. 17, 2013

(54) PAIR OF GOLF SHOES

(76) Inventor: Johannes Schwarz, Berlin (DE)

( * ) Notice: Subject to any disclaimer, the term of this patent is extended or adjusted under 35 U.S.C. 154(b) by 499 days.

(21) Appl. No.: 13/001,327

(22) PCT Filed: Jun. 24, 2009

(86) PCT No.: PCT/DE2009/000878
§ 371 (c)(1),
(2), (4) Date: Jan. 26, 2011

(87) PCT Pub. No.: WO2009/155904
PCT Pub. Date: Dec. 30, 2009

(65) Prior Publication Data

US 2011/0113652 A1 May 19, 2011

(30) Foreign Application Priority Data

Jun. 25, 2008 (DE) ..... 10 2008 029 832

(51) Int. Cl.
*A43B 5/00* (2006.01)

(52) U.S. Cl.
USPC ..... 36/127; 36/142

(58) Field of Classification Search
USPC ..... 36/127, 142, 143, 144
See application file for complete search history.

(56) References Cited

U.S. PATENT DOCUMENTS

| | | | | |
|---|---|---|---|---|
| 4,149,324 | A | 4/1979 | Lesser et al. | |
| 4,161,829 | A * | 7/1979 | Wayser | 36/127 |
| 4,524,531 | A * | 6/1985 | VanDeripe | 36/127 |
| 4,685,227 | A * | 8/1987 | Simmons | 36/127 |
| 4,704,809 | A * | 11/1987 | Ballard | 36/127 |
| 4,748,753 | A * | 6/1988 | Ju | 36/127 |
| 4,754,561 | A | 7/1988 | Dufour | |
| 4,837,949 | A | 6/1989 | Dufour | |
| 5,345,701 | A * | 9/1994 | Smith | 36/144 |
| 6,845,575 | B1 | 1/2005 | Hwang | |
| 2002/0005000 | A1 * | 1/2002 | Choi | 36/144 |
| 2009/0064539 | A1 * | 3/2009 | Park et al. | 36/88 |
| 2011/0113652 | A1 * | 5/2011 | Schwarz | 36/127 |
| 2012/0005924 | A1 * | 1/2012 | Shiue et al. | 36/127 |

FOREIGN PATENT DOCUMENTS

| | | | |
|---|---|---|---|
| AU | 4366079 | A | 7/1980 |
| AU | 4366079 | A1 | 7/1980 |
| DE | 3715451 | A1 | 11/1987 |
| DE | 3741015 | A1 | 7/1988 |
| DE | 102005017654 | A1 | 7/2006 |
| FR | 2765082 | A1 | 12/1998 |
| GB | 2000014 | A | 1/1979 |
| JP | 2003-70505 | A | 3/2003 |
| WO | 8707480 | A1 | 12/1987 |
| WO | 2004043183 | A1 | 5/2004 |

OTHER PUBLICATIONS

International Search Report, directed to International Patent Application No. PCT/DE2009/000878, mailed on Dec. 14, 2009, 2 pages.
International Preliminary Report on Patentability, directed to International Patent Application No. PCT/DE2009/000878, mailed on Mar. 31, 2011, 5 pages.

* cited by examiner

*Primary Examiner* — Marie Patterson
(74) *Attorney, Agent, or Firm* — Smith Patent Office

(57) ABSTRACT

The invention relates to a pair of golf shoes with a rolling surface supporting the swing, wherein an external rolling surface is provided along a shoe outer edge and in the big toe region to the tip region of the other shoe an inner rolling surface is provided along the shoe inner edge.

7 Claims, 4 Drawing Sheets

PAIR OF GOLF SHOES

BACKGROUND

Figure 1:
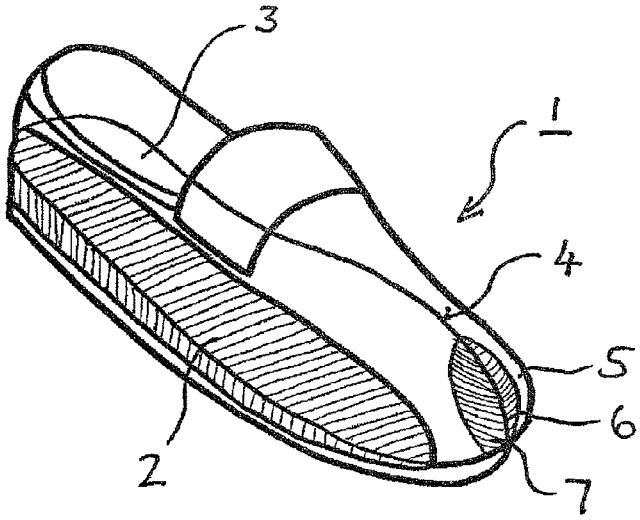

Golf shoes are sports shoes which are specially developed and equipped for golf. They are usually characterised in that slip-inhibiting elements such as, for example, spikes or other perforations are provided on the tread, to assist the secure footing of the player on the golf course, in particular in conjunction with executing the swing for playing the ball. An outsole which can be used in particular for golf shoes is described, for example, in the document DE 37 41 015 A1.

Known from the document DE 10 2005 017 654 A1 is a pair of golf shoe inserts in which reinforcing layers are formed. The reinforcing layers of the two golf shoe inserts have differently shaped reinforcing sections for selective support of the player in the swing direction during the golf swing.

The document DE 37 14 451 A1 describes a golf shoe in which the sole of the shoe is divided into two support zones which extend adjacently to one another and comprise a first passive zone which consists of a material of a specific hardness and forms the main underlayer for the foot of the user, as well as a second active zone which has a shock-absorbing element, the material of which has a lower hardness than the material of the passive zone and to which an outsole is assigned. When the known golf shoe is used by a right-handed person, the left golf shoe is provided with a foot support surface which is directed towards the inner side of the shoe. In one embodiment, a slope is further formed on the shoe sole in the area of the outer edge of the left shoe.

A golf shoe having an outer rolling surface is known from the documents JP 2003 070 505 A and GB 2 000 014 A. The document AU 43,660/79 belongs to the same patent family. An external rolling surface is also provided on a golf shoe in the document U.S. Pat. No. 4,149,324. The document WO 87/07480 also discloses an external rolling surface on a golf shoe.

A pair of golf shoes with external rolling surfaces is disclosed in the document FR 2 765 082. The document WO 2004/043183 A1 discloses a pair of golf shoes in which in one embodiment one part of the shoe sole is formed with different thickness inside and outside.

SUMMARY OF THE INVENTION

It is the object of the invention to provide an improved pair of golf shoes in which the left and right shoe are formed as an entire system in swing-supporting manner.

This object is achieved according to the invention by a pair of golf shoes having swing-supporting rolling surfaces according to claim 1. Advantageous embodiments are the subject matter of dependent claims.

The invention embraces the idea of a pair of golf shoes with swing-supporting rolling surfaces wherein an outer rolling surface is formed on one golf shoe along its outer shoe edge and an inner rolling surface is formed on the other golf shoe in its big toe region as far as into its shoe tip region along the inner shoe edge. The other golf shoe is formed with the aid of an outside foot support having an inwardly inclined foot support surface. An inclination for the inwardly inclined foot support surface in the other golf shoe is different for different foot regions and is greater in a heel region than in a forefoot region. The other golf shoe is further formed with a heel support.

With the aid of the proposed pair of golf shoes, a shoe system is created which assists and facilitates the movements to be executed as correctly as possibly by the feet of the golfer during the golf swing. Whilst the outer rolling surface facilitates and assists the rolling over the outside of the foot, the inner rolling surface fulfils the same function for the rolling and turning over the tip of the foot to be executed with the other foot. The golf shoes are configured differently, which in this respect can also be described as an "asymmetrically" constructed pair of golf shoes.

In the case of right-handed persons, the right knee joint is stabilised with the aid of the outside foot support. The other golf shoe thus formed therefore more extensively assists the biomechanically and physically predefined sequence of the golf swing. The inclination of the foot support surface in the other golf shoe can be formed to be continuously increasing from the forefoot region to the heel region. In contrast to this, the golf shoe is designed to be inclination-free. A comparable inclination of the foot support surface is therefore lacking.

The golf swing comprises a physical process which is implemented biomechanically by the human body. When viewed physically, the swing functions according to the principle of a pendulum that transports an object (golf ball) in a directional manner with the aid of a lever (golf club). Biomechanically a muscular tension is initially built up in the entire body (upswing) by the swinging back of the arms and the turning of the shoulders and the back. In the case of a right-handed person, a shift of weight onto the right leg takes place in this case, which is maximum at the end of the upswing or the energy reversal point (dead point of the pendulum). The now-following pre-swing of the arms brings about a release of the built-up muscular tension and a horizontal rotation of the entire body (through-swing), wherein the left foot remains standing and the right foot turns on its tip. During the pre-swing, a renewed weight shift of weight onto the left leg takes place. At the end of the golf swing of a right-handed person, the entire body weight is therefore located on the left leg.

For a uniform swing movement it is necessary to maintain the vertical axis of the body during the upswing. The horizontal rotation of the body during the upswing and the shift of weight onto the right leg associated herewith causes a substantial instability factor in the right knee joint. As a result of the rotation-induced right-ward shift of the right knee joint, the risk of leaving the vertical axis arises, which is one of the most frequent problems in executing the golf swing. The turning of the right knee joint to the left which is necessary for initiating the through-swing is impossible due to the previous leaving of the vertical axis. With the left-ward turning of the right knee joint during the through-swing and the renewed horizontal rotation of the body, the right foot also turns on the tip which is another problem zone of the golf swing. Here the inner rolling surface provided now assists the golfer. As a result of the rotation-induced weight shift about the vertical axis, the left foot, when remaining fully on the ground, slides over the outside of the foot onto its outer left edge, where the outer rolling surface has a supporting effect for the golfer.

The outer rolling surface can be formed over the entire shoe length. However, one configuration can be provided only over a partial region of the shoe outer edge, for example, from the toe region into the heel region wherein the outer rolling surface can stop at the beginning of or before the end of the heel. In combination with this or alternatively to this, it can also be provided that the outer rolling surface does not extend as far as into the toe region but is substantially formed in the rear shoe region as far as the middle shoe region or the beginning of the toe region.

A preferred embodiment of the invention provides that the inner and the outer rolling surface are each designed to form a surface transition between shoe sole and side shoe surface.

In a preferred embodiment of the invention, it can be provided that at least one of the rolling surfaces is formed as a rounded rolling surface. The inner or the outer rolling surface or both rolling surfaces can be formed as rounded rolling surfaces, wherein in particular a continuous rounding can be provided to further optimise the swing-induced rolling.

An advantageous embodiment of the invention provides that at least one of the rolling surfaces is formed with a slope. Both the inner and the outer rolling surfaces or both rolling surfaces can be provided with one or more bevels or slopes. In one embodiment a combination of slope and rounded rolling partial surfaces can also be provided.

A further embodiment of the invention provides that the outside foot support comprises a support on the inlay sole side. The outside foot support is formed at least partially by means of a suitably shaped inlay sole to form the inclination.

A preferred further embodiment of the invention provides that the outside foot support comprises a support on the shoe sole side. The support on the shoe sole side can be integrated in the shoe sole itself. Alternatively or additionally to this, a support element firmly connected herewith can be incorporated on the shoe sole.

DESCRIPTION OF PREFERRED EMBODIMENTS

Figure 2:
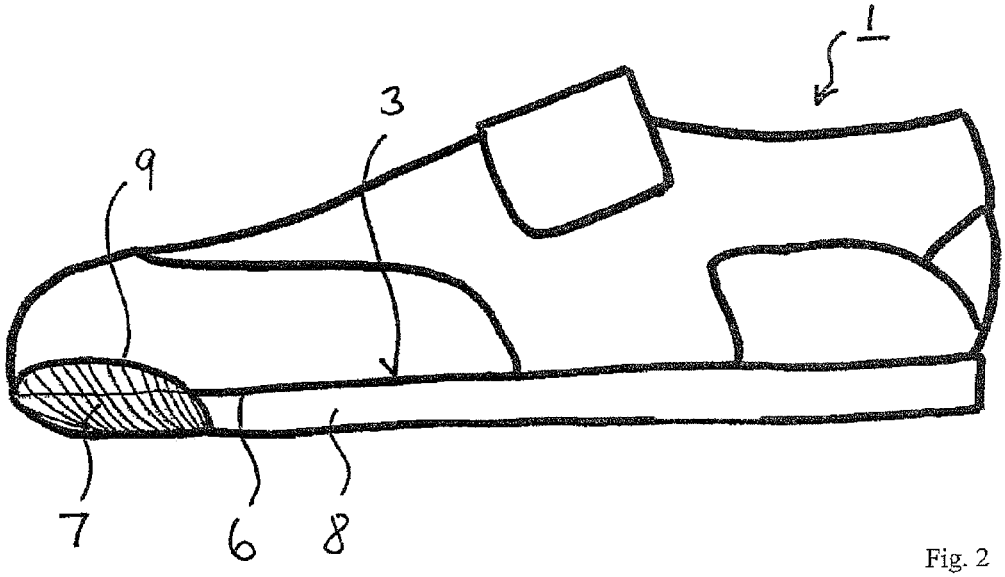
Figure 3:
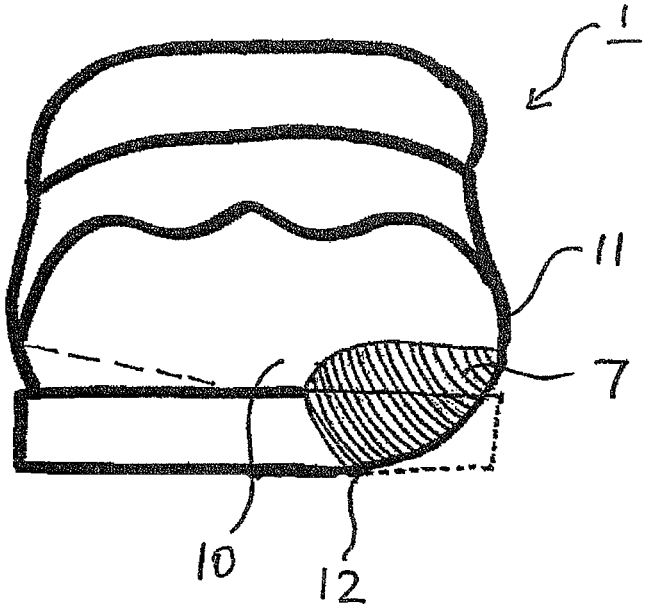
Figure 4:
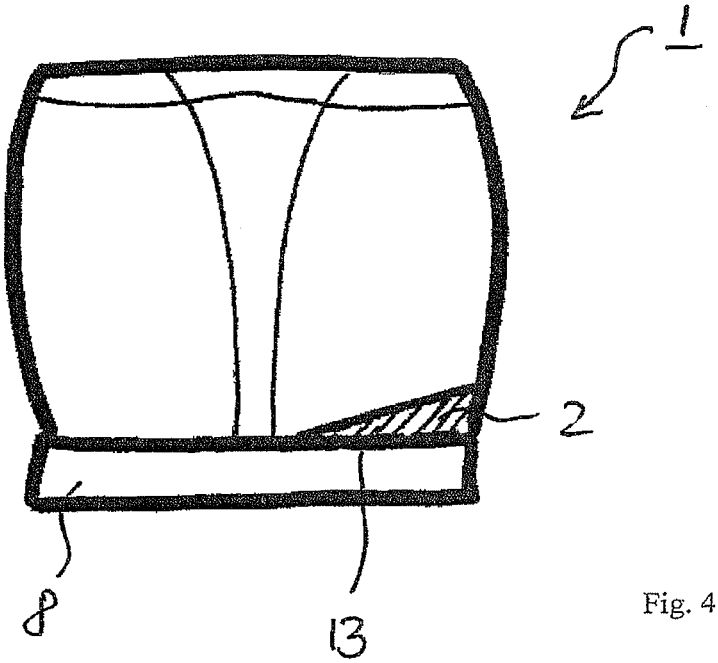
Figure 5:
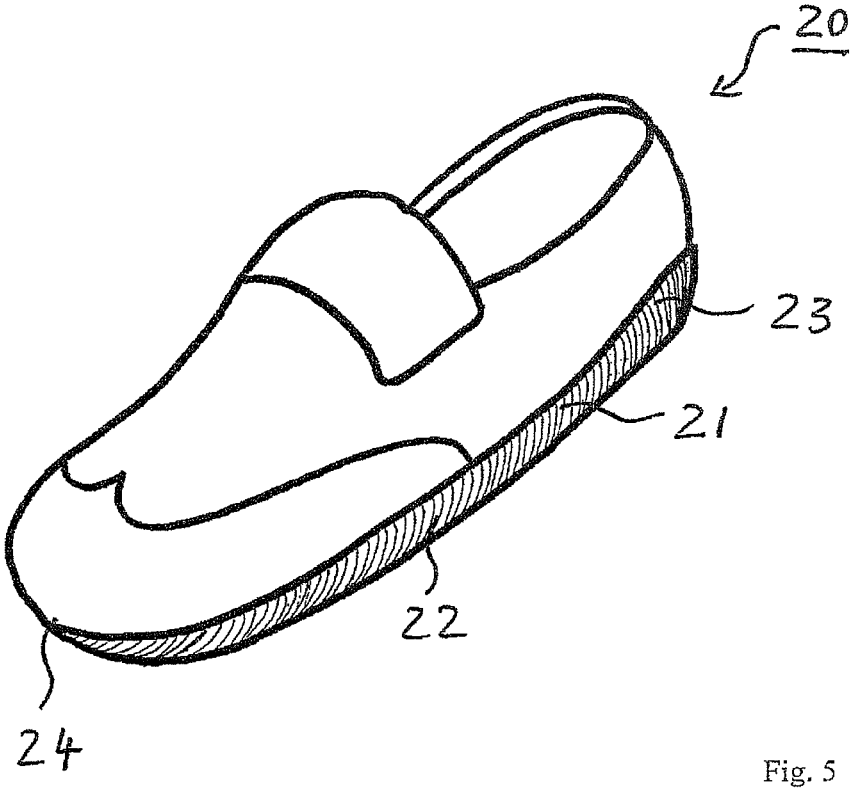
Figure 6:
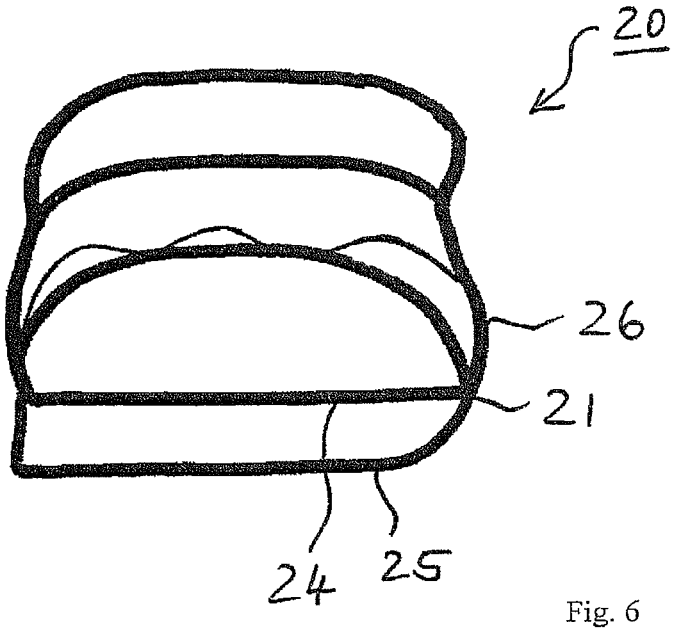
Figure 7:
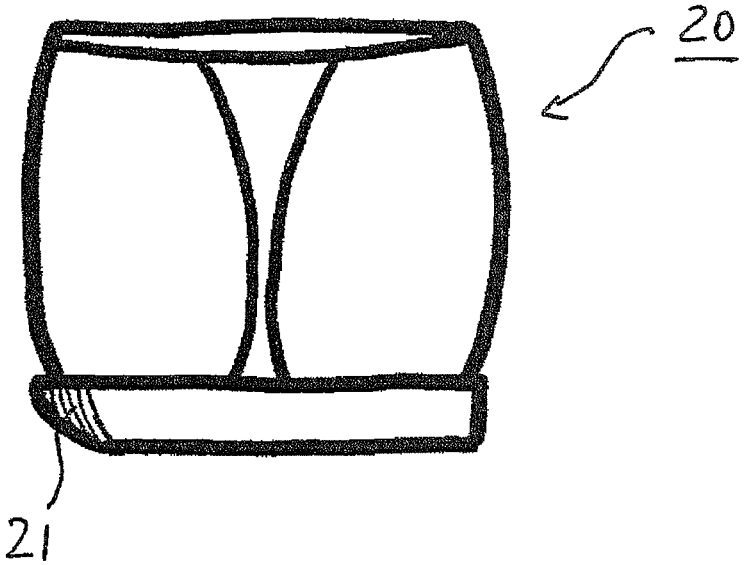

The invention is explained in detail hereinafter with reference to preferred exemplary embodiments by reference to figures in the drawings. In the figures:

FIG. 1 shows a perspective view of a right golf shoe for a right-handed person, FIG. 2 shows a side view of the right golf shoe from FIG. 1 from the left, FIG. 3 shows a front view of the right golf shoe from FIG. 1, FIG. 4 shows a rear view of the right golf shoe from FIG. 1, FIG. 5 shows a perspective view of a left golf shoe for a right-handed person, which forms a pair of golf shoes with the right golf shoe from FIG. 1, FIG. 6 shows a front view of the left golf shoe from FIG. 5 and FIG. 7 shows a rear view of the left golf shoe from FIG. 5.

FIG. 1 shows a perspective view of a right golf shoe 1 in which an outside foot support 2 is formed, by which means a foot support surface 3 acquires an inclination towards the inner side 4. An inner rolling surface 7 is formed in a big toe region 5 along a shoe inner edge 6. According to FIG. 2 the inner rolling surface 7 begins in the region of a shoe sole 8 and extends as far as into the region of an inner side 9 of the right golf shoe 1.

FIG. 3 shows a front view of the right golf shoe 1 from FIG. 1. It is found that the inner rolling surface 7 extends as far as into the region of a shoe tip 10. The inner rolling surface 7 connects a side shoe surface 11 to a tread 12.

FIG. 4 shows a rear view of the right golf shoe 1 from FIG. 1. The foot support 2 is formed by means of an inlay element 13. In another configuration (not shown) the foot support is formed with the aid of the shoe sole itself.

FIG. 5 shows a perspective view of a left golf shoe 20 in which an outer rolling surface 22 is formed along a shoe outer edge 21. The outer rolling surface 22 extends over the entire shoe length from a heel region 23 as far as the shoe tip 24.

According to FIG. 6, the outer rolling surface 22 is formed as a continuously rounded surface from an outsole 25 to the shoe side surface 26.

FIG. 7 shows a rear view of the left golf shoe 20 from FIG. 5.

In the case of a left-handed person, the preceding explanations apply accordingly where right and left shoe are exchanged.

The features of the invention disclosed in the description above, the claims and the figures can be used individually as well as in any desired combination to realise the invention in its various embodiments of importance.

The invention claimed is:

1. A pair of golf shoes with swing-supporting rolling surfaces, comprising:

an outer rolling surface is formed on one golf shoe along its outer shoe edge, an inner rolling surface is formed on the other golf shoe in its big toe region as far as into its shoe tip region along the inner shoe edge, the other golf shoe is formed with the aid of an outside foot support having an inwardly inclined foot support surface, the inclination for the inwardly inclined foot support surface in the other golf shoe is different for different foot regions and is greater in a heel region than in a forefoot region and the other golf shoe is formed with a heel support.

2. The pair of golf shoes according to claim 1, wherein the inner and the outer rolling surface are each designed to form a surface transition between shoe sole and side shoe surface.

3. The pair of golf shoes according to claim 1, wherein at least one of the rolling surfaces is formed as a rounded rolling surface.

4. The pair of golf shoes according to claim 1, wherein at least one of the rolling surfaces is formed with a slope.

5. The pair of golf shoes according to claim 1, wherein the outside foot support comprises a support on the inlay sole side.

6. The pair of golf shoes according to claim 1, wherein the outside foot support comprises a support on the shoe sole side.

7. The pair of golf shoes according to claim 2, wherein at least one of the rolling surfaces is formed as a rounded rolling surface.

* * * * *